US010366571B1

(12) United States Patent
Wurmbrand et al.

(10) Patent No.: US 10,366,571 B1
(45) Date of Patent: Jul. 30, 2019

(54) ELECTRONIC GAMING MACHINE WITH PROJECTILE WHICH ELIMINATES SYMBOLS

(71) Applicants: Rachel Wurmbrand, Las Vegas, NV (US); Daniel Sahl, Las Vegas, NV (US)

(72) Inventors: Rachel Wurmbrand, Las Vegas, NV (US); Daniel Sahl, Las Vegas, NV (US)

( * ) Notice: Subject to any disclaimer, the term of this patent is extended or adjusted under 35 U.S.C. 154(b) by 0 days.

(21) Appl. No.: 15/913,909

(22) Filed: Mar. 6, 2018

(51) Int. Cl.
*G07F 17/32* (2006.01)

(52) U.S. Cl.
CPC ..... *G07F 17/3262* (2013.01); *G07F 17/323* (2013.01); *G07F 17/3213* (2013.01); *G07F 17/3286* (2013.01); *G07F 17/3209* (2013.01); *G07F 17/3234* (2013.01); *G07F 17/3239* (2013.01); *G07F 17/3246* (2013.01); *G07F 17/3248* (2013.01)

(58) Field of Classification Search
None
See application file for complete search history.

(56) References Cited

U.S. PATENT DOCUMENTS

2005/0035550 A1* 2/2005 Jackson ..... G07F 17/3297 273/292
2014/0031097 A1* 1/2014 Brosnan ..... A63F 13/10 463/2
2017/0024967 A1* 1/2017 Litman ..... G07F 17/3258
2017/0228964 A1* 8/2017 Gonzalez-Roa ..... G07F 17/329

* cited by examiner

*Primary Examiner* — Ronald Laneau

(57) ABSTRACT

A wagering method includes display of random symbols in a grid array of rows and columns of frames displayed on a visual screen. The player receives a number of directable virtual projectiles. The player selects a trajectory for the virtual projectile that passes into the grid array. The processor moves the virtual projectile on the visual screen along the selected trajectory and eliminates symbols within penetrated frames. Each virtual projectile has a designated frame penetrating strength. Each moved virtual projectile passes into and through frames until the virtual projectile exhausts its frame penetrating strength, and eliminates symbols in each frame the virtual projectile penetrates. The processor accumulates all symbols eliminated in ordered arrays of like symbols or orders of symbols.

20 Claims, 11 Drawing Sheets

| Scatter Pay | 3 | 4 | 5 | 6 | 7 | 8 | 9 | 10 | 11 | 12 |
|---|---|---|---|---|---|---|---|---|---|---|
| WILD | 500 | 600 | 1000 | 1200 | 1500 | 1800 | 2000 | 2500 | 3000 | 3500 |
| ✦ | 200 | 300 | 400 | 500 | 600 | 700 | 800 | 900 | 1000 | 1500 |
| ☾ | 100 | 200 | 300 | 400 | 500 | 600 | 700 | 800 | 900 | 1000 |
| ✖ | 30 | 50 | 100 | 150 | 200 | 250 | 300 | 350 | 400 | 500 |
| ♥ | 30 | 50 | 100 | 150 | 200 | 250 | 300 | 350 | 400 | 500 |
| ◀ | 30 | 50 | 100 | 150 | 200 | 250 | 300 | 350 | 400 | 500 |

ELECTRONIC GAMING MACHINE WITH PROJECTILE WHICH ELIMINATES SYMBOLS

BACKGROUND OF THE INVENTION

1. Field of the Invention

The present invention relates to the field of gaming technology, particularly electronic gaming machines (EGMs), and more particularly with respect to EGMs with an apparent skill input, but in which skill cannot increase any maximum award randomly available from symbols displayed on the visual display in the EGMs.

2. Background of the Art

Electronic gaming, especially electronic gaming machines which simulate slot reel machines and other systems in which there are random distributions of arrays of symbols still constitute the bulk of profits in the United States and other countries, even though the largest wagering amounts are present in baccarat and blackjack. It has always been felt to be desirable to introduce new variations in electronic gaming machines (EGMs) so that players do not get fatigued with old games, and to attract new players to games, especially using new themes or characters to which players might relate. This route of changing games and images, while still automatically providing game play without substantive player input has reached a relatively stable position within the industry. Without adding substantive content to EGM play, the life of new games has shortened and revenues have remained flat.

In September of 2015, some gaming jurisdictions in the United States finally allowed some level of skill-based gaming to be used in conjunction with EGM play. The type of skill has to be carefully selected, or the house advantage could be dramatically shifted to players and the casinos could lose substantial funds. For example, even though question based skill (e.g., as in Jeopardy® games) could be used, more intelligent or knowledgeable players would have a significant advantage over players. Also, with information readily and quickly available to players through smart phones and other communication devices, players could obtain information-based question responses with outside assistance.

The more preferable type of skill to be allowed in the play of gaming systems will be more manual or physical input by players such as rapidity of button or touchscreen entry, proper ordering of button or touchscreen entry, correct manipulation of joy-sticks, correct manipulation of touch-screen objects, controlled direction of objects/projectiles, proper control of wheels (e.g., steering wheels) or levers, control or completion of timed events, length of activity in timed events (especially with increasing levels of difficulty) and other events requiring actual activity by players that include physical control of images and objects beyond random outcomes initiated by acceptance of a wager.

One set of problems in offering these new skill-based games is the concern that players are not willing to risk significant amounts of funds in a learning experience and that the games may languish on the floor. Although it has been known to offer demonstration modes in new games, these demonstration modes have typically been video play which shows how to place wagers, how to initiate games, how the games perform during activity and the like, but there has been no mechanism for enabling actual skill-based player input to the games without a costly learning curve for players. The rapid turnover rate for wagering on EGMs during game play, is quite different from the unlimited time for players to learn on home entertainment systems, where neither cost nor time is a factor.

U.S. Pat. No. 5,324,035 (Morris); U.S. Pat. No. 5,551,692 (Pettit); U.S. Pat. No. 7,220,180 (Kaminkow); and U.S. Pat. No. 7,294,056 (Lowell) demonstration mode show demonstration modes, demonstration loops and non-cash auto-play in skill-based gaming.

U.S. Pat. No. 8,337,294 (Sharkov) provides a typical description of demonstration modes. Turning to FIGS. 10-14, the system may include a demonstration feature 80 so that potential users may learn how to use the system without having to wager their own funds. Selecting the demonstration option 82 may launch a mock-version of the game. The mock-version may show the user how to place a bet, how to spin the reels to determine which bets will be part of the combi-bet, and how to view and analyze the user interface to determine whether the combi-bet is a winner. At any point during the demonstration, the system may allow the user to exit the demonstration and proceed to the actual wagering portion of the system.

What is needed in the gaming industry is an EGM that gives an appearance of skill-based player input, and adds entertainment value to the system, yet does not create any substantive advantage to maximum award attainment by individuals based on any truly measurable skill.

SUMMARY OF THE INVENTION

A method executes a wagering event on an electronic gaming machine (EGM). The EGM includes a housing, a video screen, a processor having associated memory, and player input controls. The player input controls further include a hand or finger controlled guiding element for directing a trajectory of a virtual projectile displayed by the processor on the video screen. The player input controls also include a value-in-value system comprising a ticket-in-ticket-out component with a ticket scanner and ticket printer, and a currency validator with a visual capture component and a motor to retrieve and eject currency. Other value-in-value-out systems may include near-field communication or RF electronic payment and crediting systems. The method includes:

a) the processor receiving a wager on a gaming event in which random symbols are randomly distributed in a grid array of at least three rows and at least three or four columns of frames within which the random symbols are displayed on the visual screen;
b) the player also receiving a number of directable virtual projectiles;
c) the player, through controlled guiding element, selecting a trajectory for the virtual projectile that passes into the grid array;
d) the processor moving the virtual projectile on the visual screen along the selected trajectory;
e) each virtual projectile having a designated frame penetrating strength;
f) each moved virtual projectile passing into frames until the virtual projectile exhausts its frame penetrating strength and eliminating symbols in each frame the virtual projectile penetrates;
g) the processor accumulating all symbols eliminated in ordered arrays of like symbols or orders of symbols; and h) after all projectiles have been moved and all eliminated symbols accumulated, the processor resolves the received wager against a paytable stored in the memory, with amounts of award depending upon correspondence of the accumulated symbols to the paytable.

DETAILED DESCRIPTION OF THE INVENTION

Figure 1:
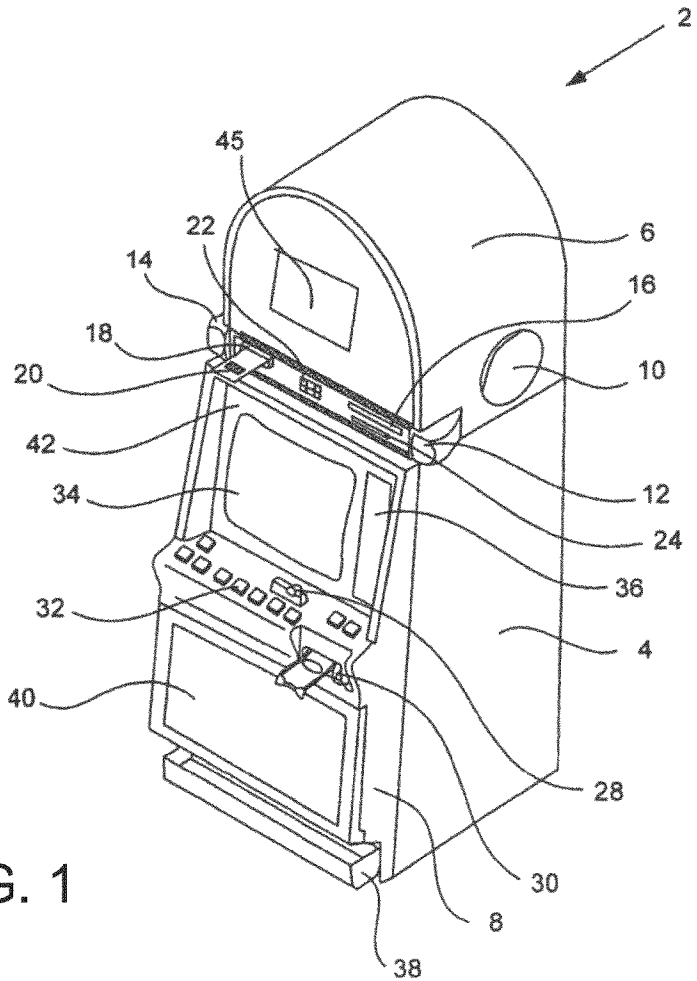
FIG. 1 shows an electronic gaming machine on which the gaming method may be executed.

In the practice of the present technology, it must be pointed out that even though there is required player "targeting" or "aiming," there should be no significant advantage or disadvantage among normal players with different physical or intellectual abilities.

A method executes a wagering event on an electronic gaming machine (EGM). The EGM may be present in the form of a single stand-alone machine, a bank of machine with individual display screens, a multiplayer platform having multiple player input controls associated with a large communal screen, a table-top gaming system, or the like. The EGM includes a housing, a video screen, a processor having associated memory, and player input controls. The player input controls further include a hand (e.g., knob, joystick, touchscreen, dial, buttons and the like) or finger controlled (e.g., knob, joystick, touchscreen, dial, buttons and the like) guiding element(s) for directing a trajectory of a virtual projectile displayed by the processor on the video screen. The guiding element is manipulated to provide a virtual trajectory across the visual display (e.g., a screen or panel). The player input controls also include a value-in-value system comprising a ticket-in-ticket-out component with a ticket scanner and ticket printer, and a currency validator with a visual capture component and a motor to retrieve and eject currency. Other value-in-value-out systems may include near-field communication or RF electronic payment and crediting systems and coin deposit and return systems more common ten years ago in casinos.

The method includes actions such as:

a) the processor receives a wager on a gaming event in which random symbols are randomly distributed in a grid array of at least three rows and at least three or at least four columns of frames within which the random symbols are displayed on the visual screen. It is preferred that there be 3×5, 4×5, or 5×5 frames in the grid array;

b) the player also receives a number of directable virtual projectiles. The projectiles may be received as a random number of virtual projectiles (e.g., at least one and fewer than five virtual projectiles). Each projectile may have a penetrating strength, which is a measure of how many frames the virtual projectile may penetrate before its penetrating strength is exhausted. The penetrating strength may be indicated by the size of the virtual projectile, its color, a number on the virtual projectile or just random assignment of penetrating value by the processor;

c) the player, through the controlled guiding element, selects a trajectory for the virtual projectile that passes into the grid array. The gaming protocols may allow time or angular distance limits for rotation limiting controls. The controlled guiding element may emit a virtual projectile path as the controlled guiding element is adjusted, such as a light track, dashed line, solid line, or the like. The virtual source of the projectile may look like any virtual projectile emitting device of system, such as a gun, rile, slingshot, bow and arrow, cannon, spear, laser weapon, knife, or the like. The projectiles may have any desired appearance, such as a ball, square, geometric shape, bullet, arrow, etc., and any color or numbering as may be needed for any allowed identification of penetrating strength;

d) the processor moving the virtual projectile on the visual screen along the selected trajectory. The projectile travels along the selected trajectory at a standard predetermined pace which may be uniform or vary according to the penetrating strength assigned to the projectile;

e) each virtual projectile having a designated frame penetrating strength, such as the ability to penetrate one, two, three or four frames. It is possible to also assign a "blank" projectile which would not be able to penetrate any frames. This would be especially of interest where the projectiles have random frame penetrating strengths with no indication of that value until the projectile moves;

f) each moved virtual projectile passes into frames until the virtual projectile exhausts its frame penetrating strength and eliminating symbols in each frame the virtual projectile penetrates. The projectile may remain the same size and/or color and/or shape as it penetrates the frames, or they may change as an indication o their waning frame penetrating strength;

g) the processor accumulates all symbols eliminated in ordered arrays of like symbols or orders of symbols. The symbols eliminated may be stored in virtual boxes to indicate how the accumulation process is progressing, and to assist in resolving wagers. Each type of symbol may have different potential values, as is evidenced in some reel slot machines, where a highest symbol (e.g., a "7") has a higher payout, a progressive symbols (e.g., bars, bells, cherries, and the like) have lower values when collected; and h) after all projectiles have been moved and all eliminated symbols accumulated, the processor resolves the received wager against a paytable stored in the memory, with amounts of award depending upon correspondence of the accumulated symbols to the paytable.

The selected virtual projectile trajectory may be displayed on the visual display as the virtual projectile trajectory is selected through player input controls.

A virtual projectile launching device may be shown on the display screen. The virtual projectile launching device may selected from the group consisting of guns, rifles, musket, bows and arrows, slingshots, rocket launch pads, laser emitters, and cannons.

The number of the virtual projectiles may be randomly provided after the wager is received and may be a constant number or a random number of at least 1 and less than or equal to 5, 4, 3, or 2. The method may use at least two different virtual sizes of projectiles are displayed, with different sizes of the projectiles indicating different frame penetrating strengths for different projectiles. For example, at least larger virtual projectiles will have greater frame penetrating strength than smaller virtual projectors. The method may also provide at least two different virtual colors of projectiles are displayed, with different colors of the projectiles indicating different frame penetrating strengths for different projectiles.

The earlier statement that even though there is required player "targeting" or "aiming," there should be no significant advantage or disadvantage among normal players with different physical or intellectual abilities shall be discussed in further detail. When the processor selects random symbols (or random templates of distributed symbols) for display on a grid array, a single maximum set of symbols that could be collected (by targeting and removal) exists on the screen. Based on the random number (or fixed number) of projectiles and the number of frames that can be penetrated by the total penetrating strength of the total number of projectiles, there is always a single selection of trajectories using the total penetrating strength of all available projectiles that will produce a maximum award on the wagers based on the symbols that can be collected. No amount of skill can increase the available maximum payouts using the allotted number and strength of projectiles provided. Also, by "aiming" the projectiles and the processor providing a projected trajectory, every player can readily view the number and types of displayed symbols that can be accumulated by removal. The processor may also provide a projected "score sheet" for each trajectory and collection of trajectories, so the player can maximize expected outcomes by readjusting the aim.

Figure 2:
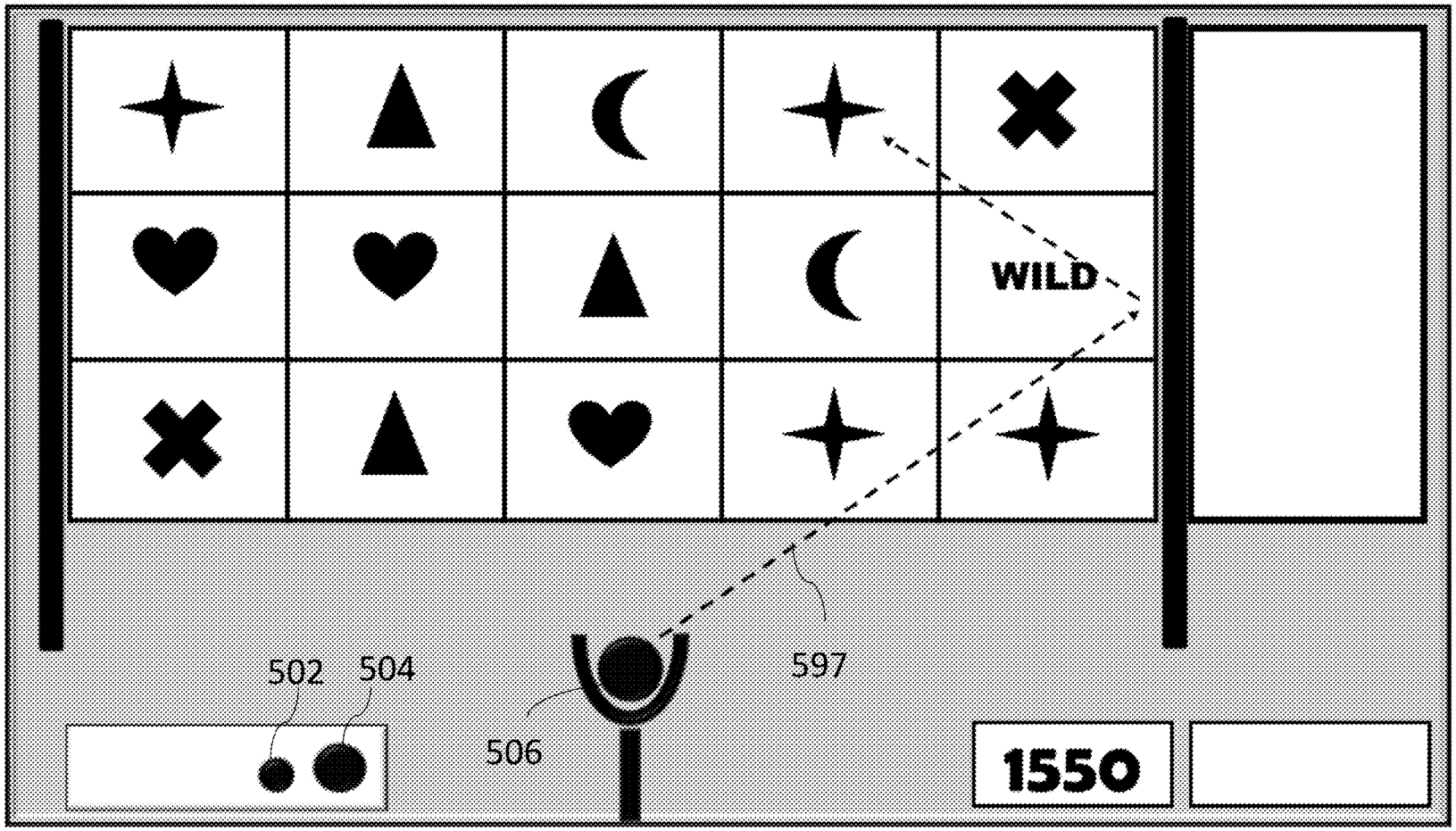
FIG. 2 is a screen shot of a first screen in an electronic gaming machine executing the wagering event of the present invention after a first targeting alignment.

FIG. 2 is a screen shot of a first screen in an electronic gaming machine executing the wagering event of the present invention after a first targeting alignment. Shown are two stored projectiles 502 (having a penetrating power of one frame, based on its relative size), and 504 (having a penetrating power of two frames based on its relative size. Also shown in armed projectile 506 positioned and aimed to be on a trajectory 597 which, if it had sufficient penetrating power, would follow the dash path and pass through four frames, and if it has only a penetrating power of three frames, will penetrate through only three frames.

Figure 3:
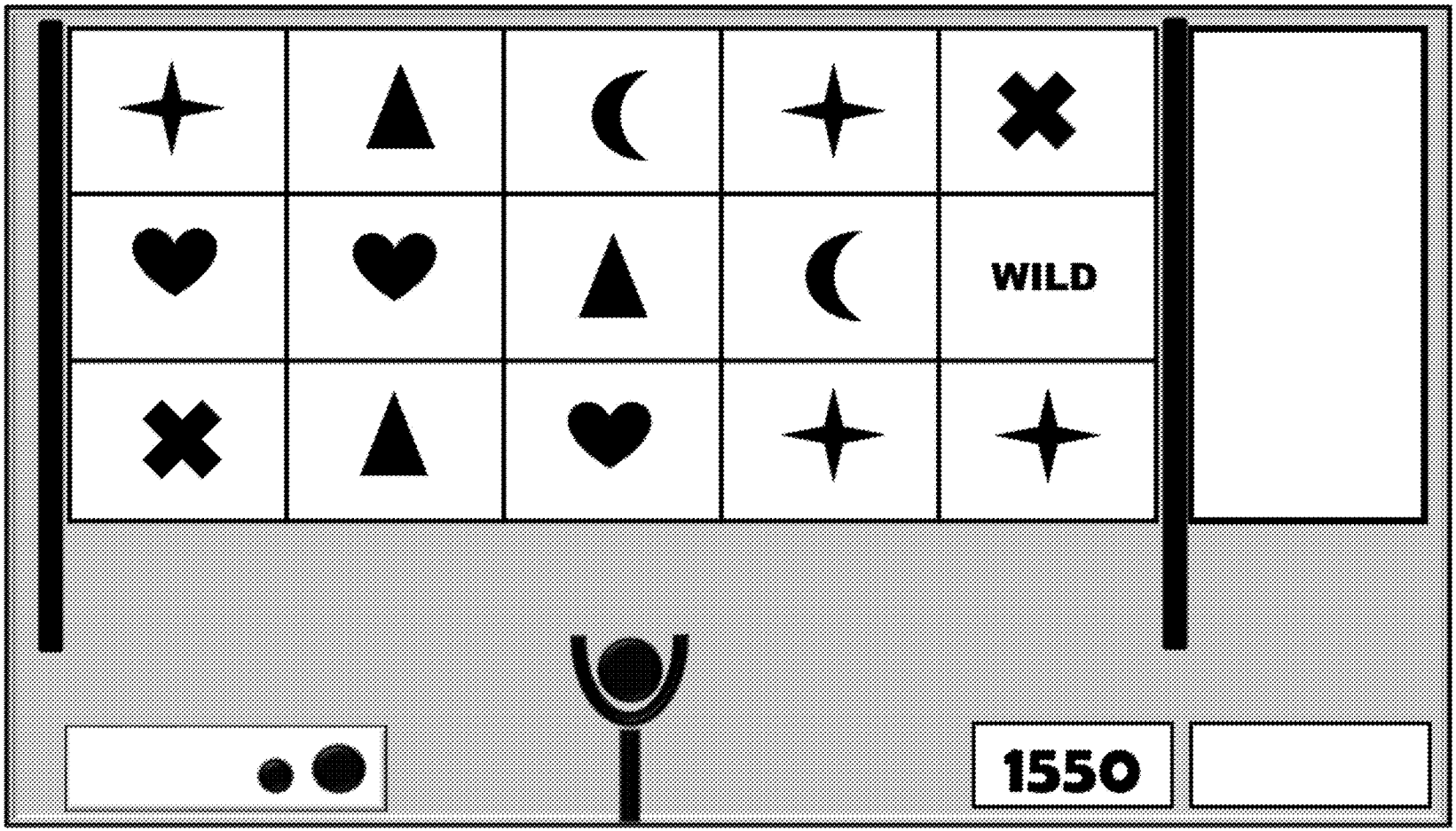
FIG. 3 is a screen shot of a first screen in an electronic gaming machine executing the wagering event of the present invention before a first targeting alignment.

FIG. 3 is a screen shot of a first screen in an electronic gaming machine executing the wagering event of the present invention before a first targeting alignment.

Figure 4:
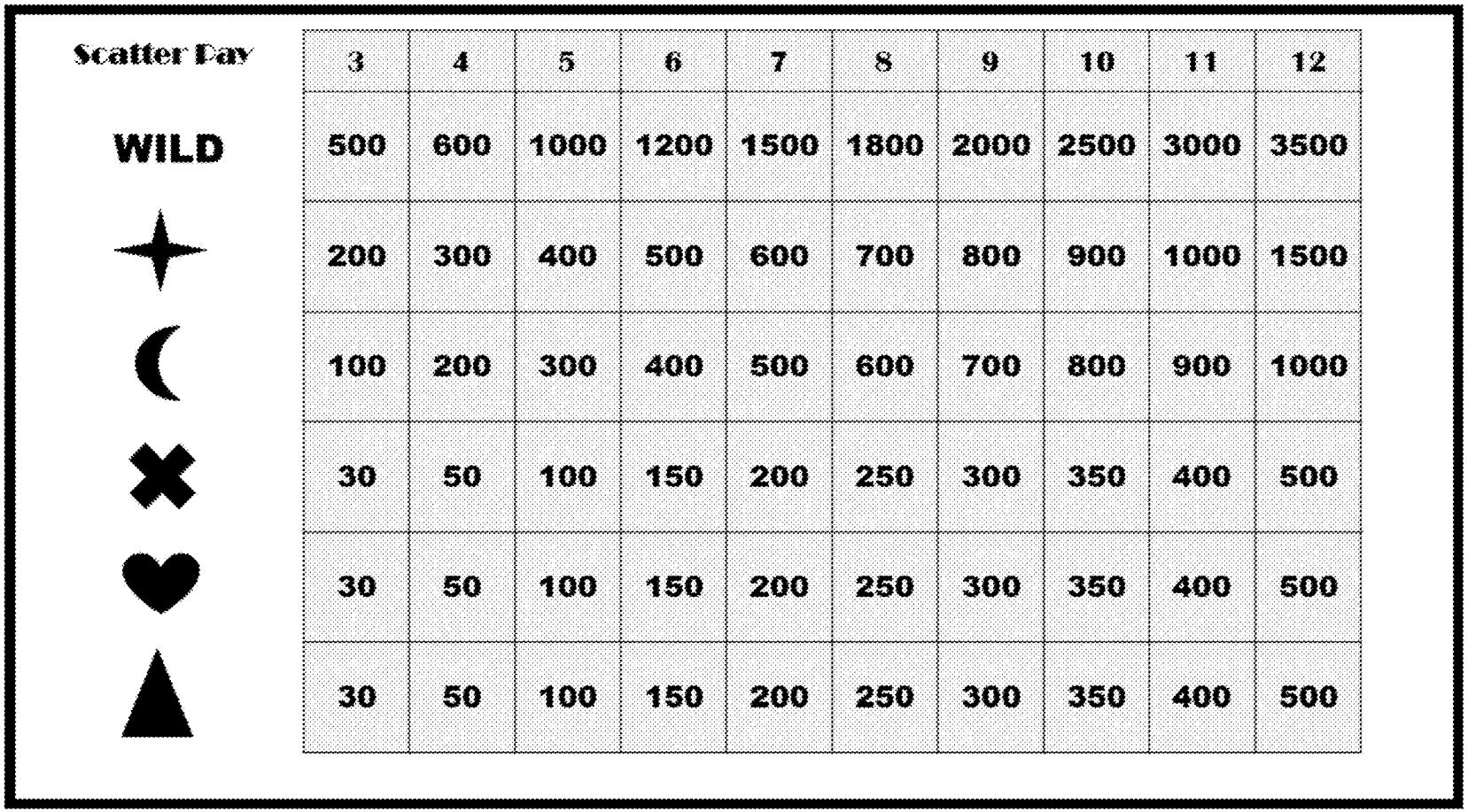
FIG. 4 is an image of an exemplary paytable according to one version of the present wagering technology.

FIG. 4 is an image of an exemplary paytable according to one version of the present wagering technology.

Figure 5:
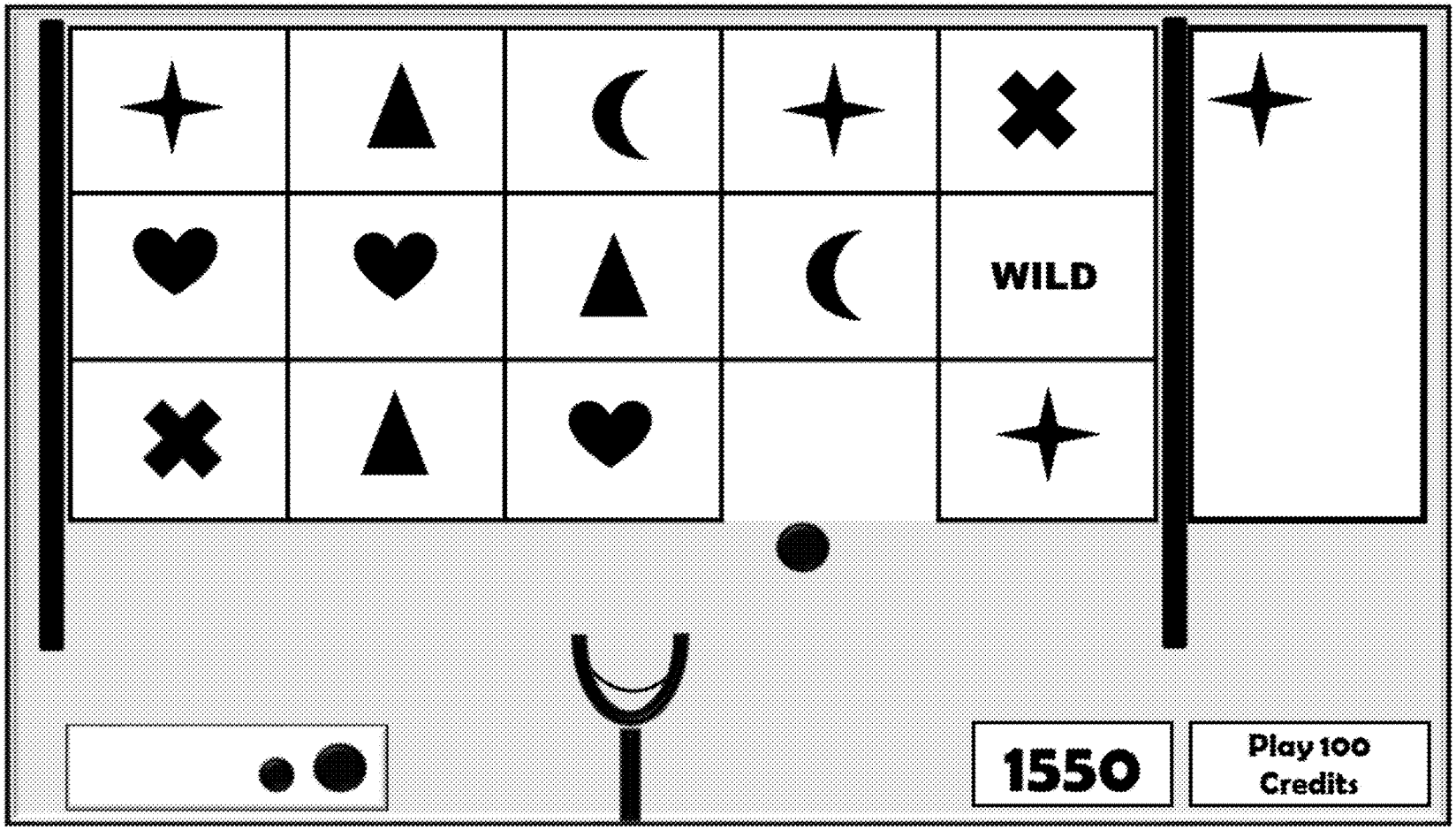
FIG. 5 is a screen shot of a wagering event of the present technology after a first projectile has been moved and has penetrated a frame, and the symbol within the frame accumulated.

FIG. 5 is a screen shot of a wagering event of the present technology after a first projectile has been moved and has penetrated a frame, and the symbol within the frame accumulated.

Figure 6:
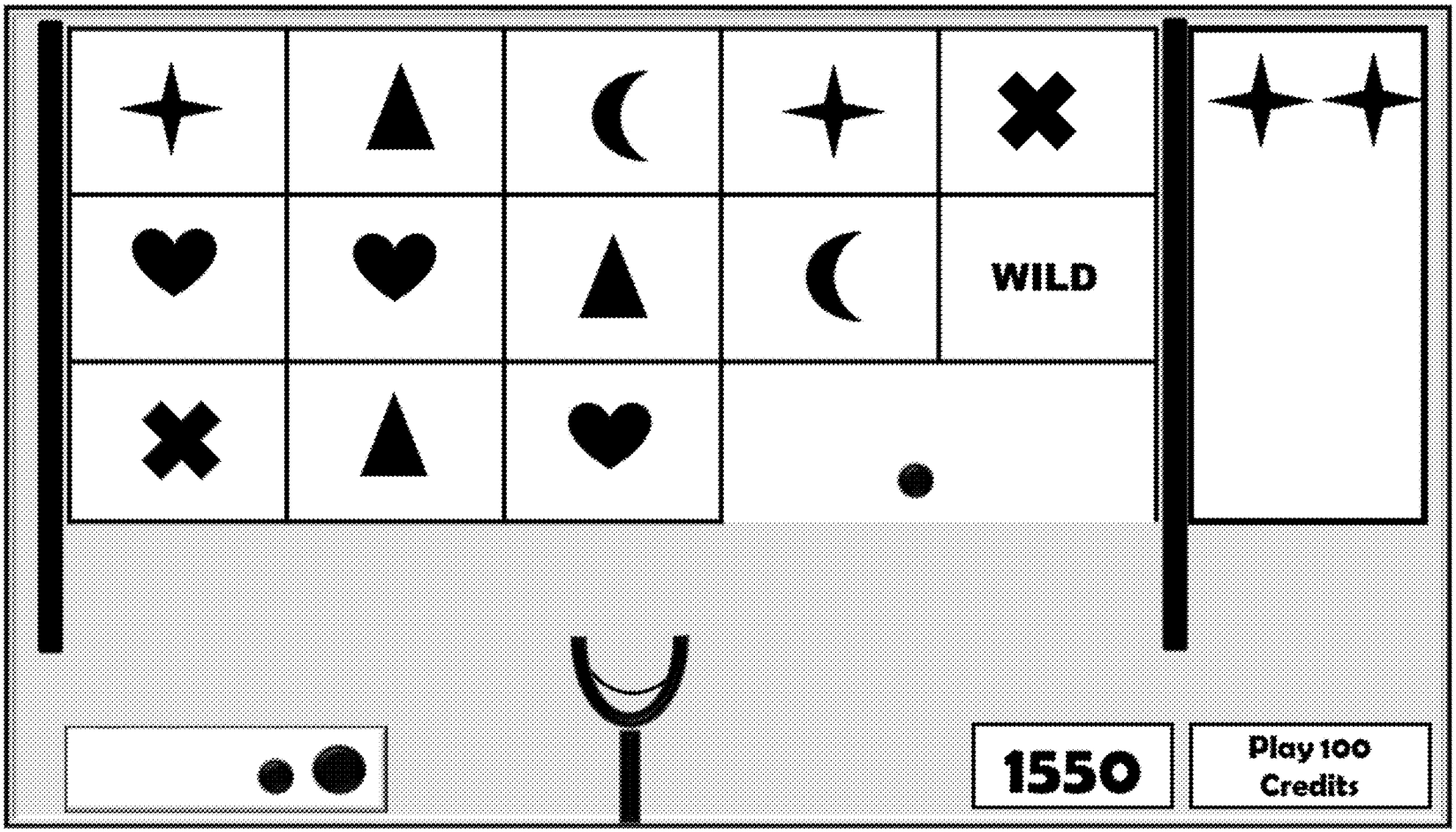
FIG. 6 is a screen shot of a wagering event of the present technology after a first projectile has been moved and has penetrated two frames, and the symbols within the frames accumulated.

FIG. 6 is a screen shot of a wagering event of the present technology after a first projectile has been moved and has penetrated two frames, and the symbols within the frames accumulated.

Figure 7:
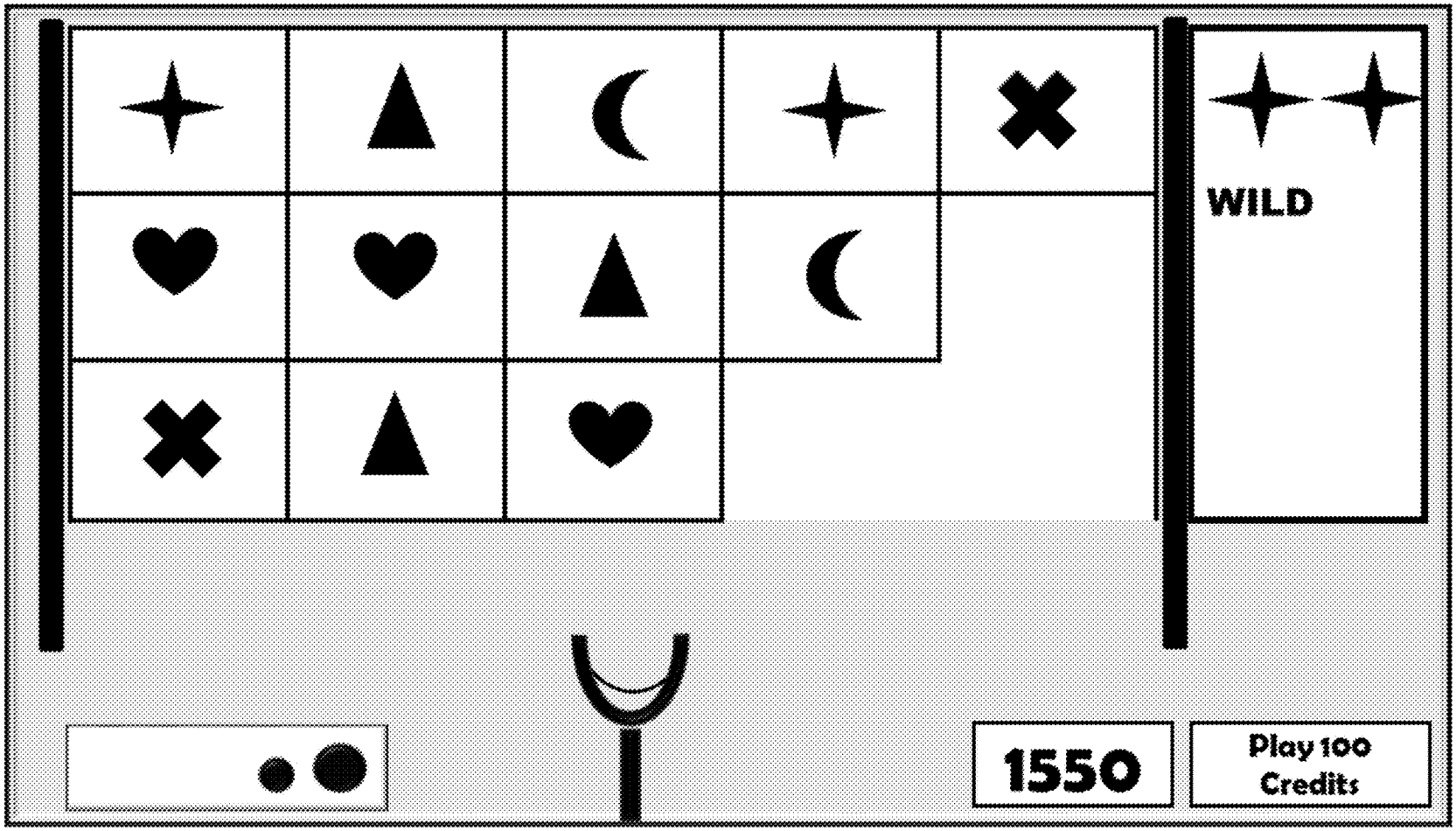
FIG. 7 is a screen shot of a wagering event of the present technology after a first projectile has been moved and has penetrated three frames, and the symbols within the frames accumulated and the projectile exhausted, being unable to penetrate any more frames.

FIG. 7 is a screen shot of a wagering event of the present technology after a first projectile has been moved and has penetrated three frames, and the symbols within the frames accumulated and the projectile exhausted, being unable to penetrate any more frames.

Figure 8:
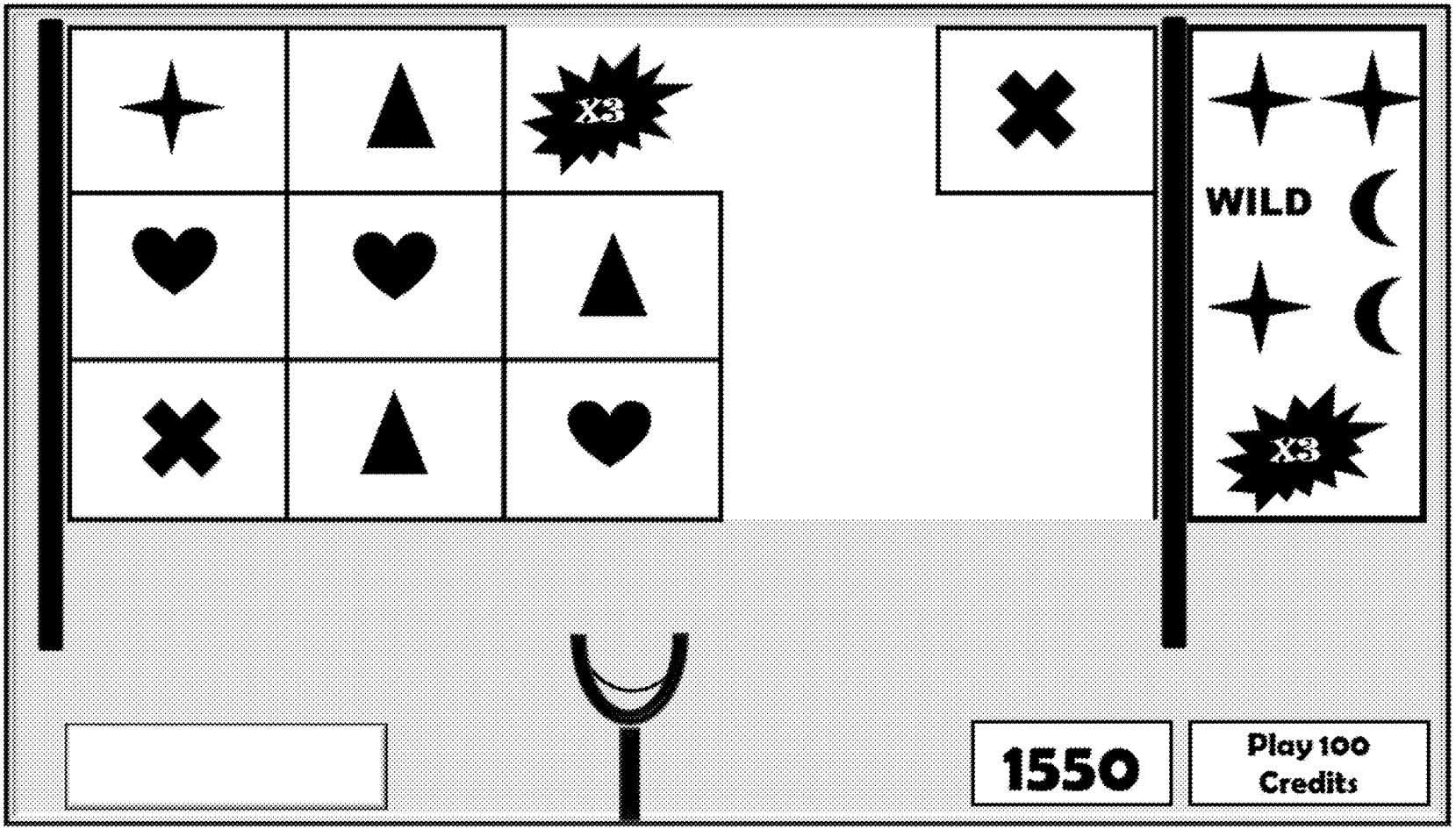
FIG. 8 is a screen shot of a wagering event of the present technology after all three projectiles have been moved and has penetrated six frames, and the symbols within the frames accumulated and the three projectiles have been exhausted, being unable to penetrate any more frames.

FIG. 8 is a screen shot of a wagering event of the present technology after all three projectiles have been moved and has penetrated six frames, and the symbols within the frames accumulated and the three projectiles have been exhausted, being unable to penetrate any more frames.

Figure 9:
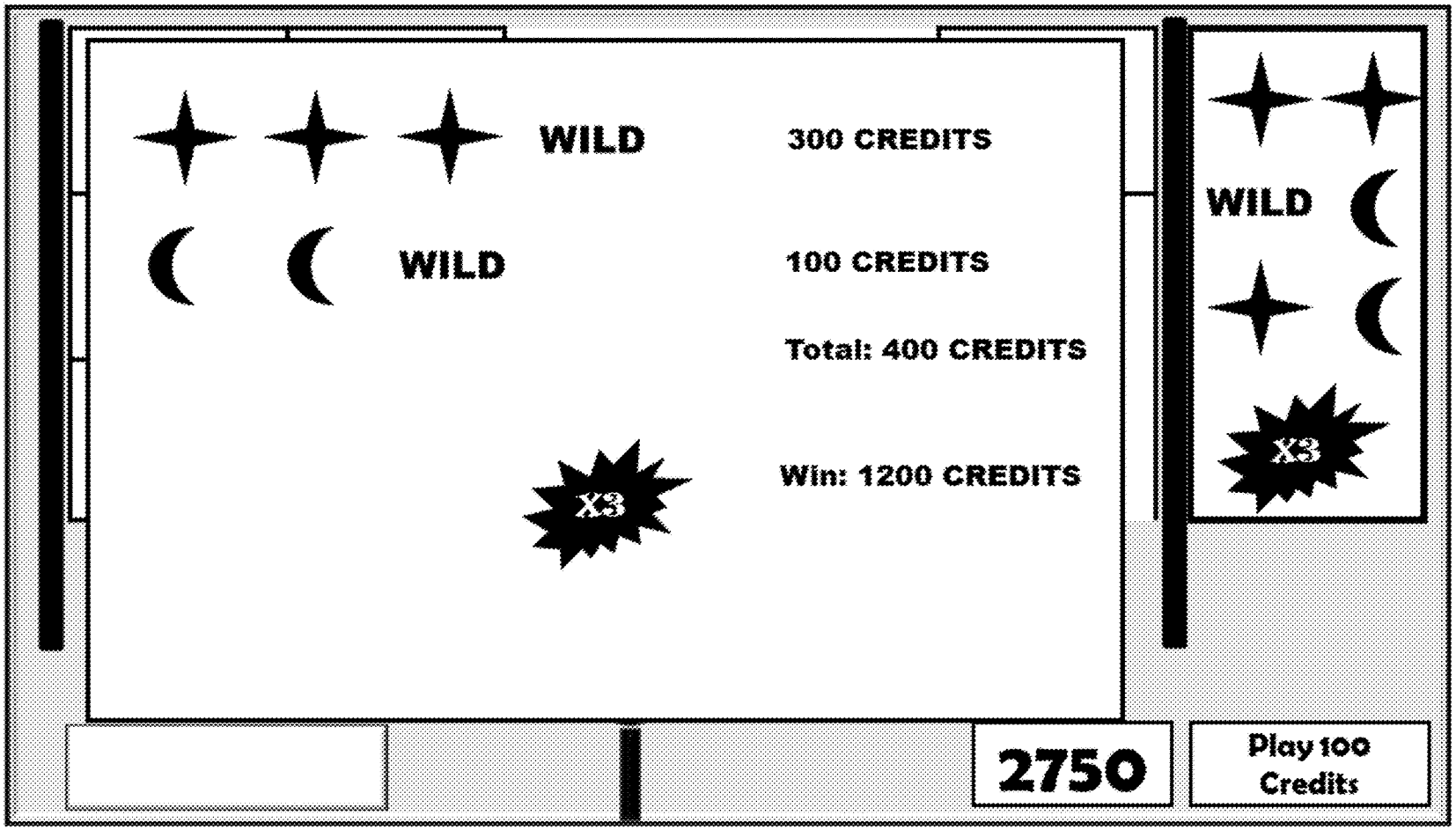
FIG. 9 shows a processor determined resolution of the final tabulation of winning event outcomes provided in the final screen shot of FIG. 8.

FIG. 9 shows a processor determined resolution of the final tabulation of winning event outcomes provided in the final screen shot of FIG. 8.

Variations in the technology might include one or more of the following. Including wild symbols that will automatically complete the best possible combination of symbols. Multiline game (five or nine paying lines instead of just three). Game math could be completed using Template algorithm (see U.S. Pat. Nos. 6,117,009 and 6,159,096 (Yoseloff), which are incorporated herein in their entirety. Game math could simply assign different probabilities for each distribution of symbols within the frames and what the maximum outcome could be for any distribution of symbols and available projectiles.

Figure 1A:
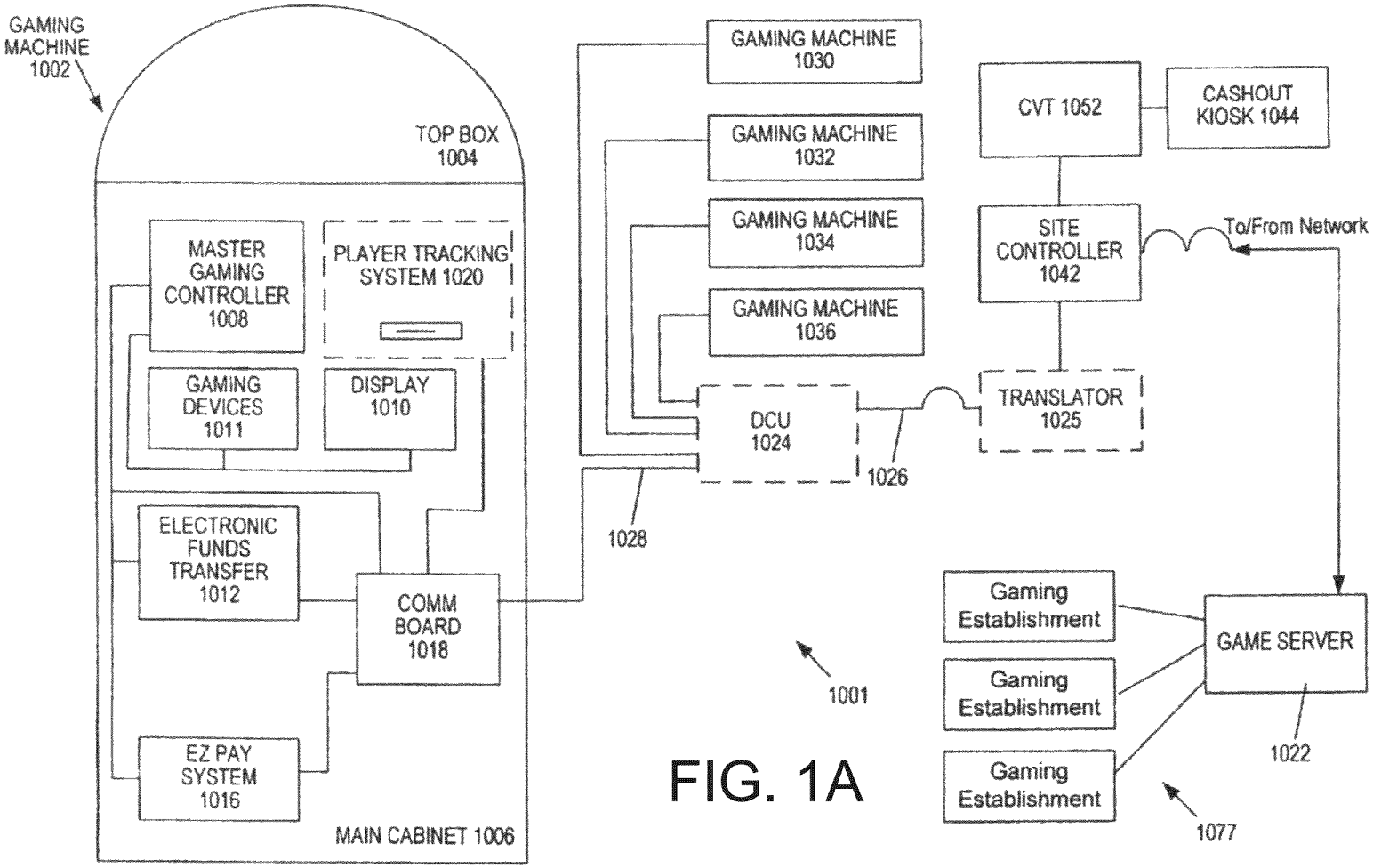
FIG. 1A shows a schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
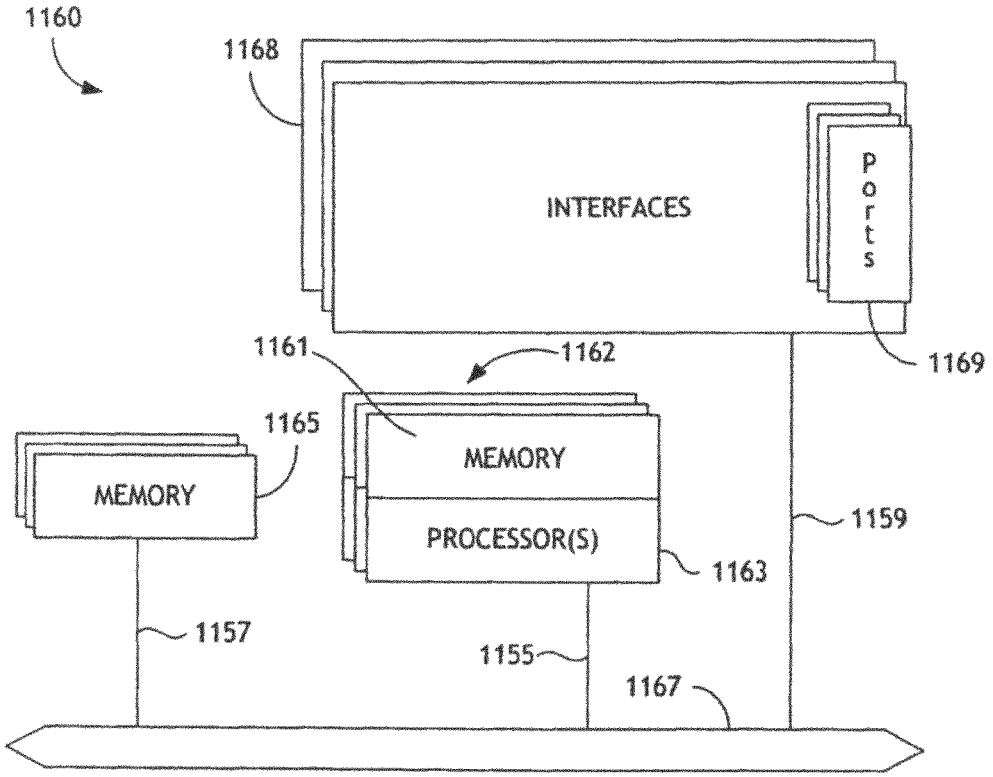
FIG. 1B shows another schematic for an electronic system for enabling play of the gaming method described herein.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention also relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention also relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter. Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

Turning next to FIG. 1, a video gaming machine 2 of the present invention is to shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown, or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display-mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or to additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or to player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

The invention claimed is:

1. A method of executing a wagering event on an electronic gaming machine comprising a housing, a video display, a processor having associated memory, and player input controls, wherein the player input controls further comprise a hand or finger controlled guiding element for directing a trajectory of a virtual projectile displayed by the processor on the video screen and a value-in-value system comprising a ticket-in-ticket-out component with a ticket scanner and ticket printer, and a currency validator with a visual capture component and a motor to retrieve and eject currency, and wherein the method comprises:

a) the processor receiving a wager on a gaming event in which random symbols are randomly distributed in a grid array of at least three rows and at least three columns of frames within which the random symbols are displayed on the visual screen;

b) the player also receiving a number of directable virtual projectiles;

c) the player, through controlled guiding element, selecting a trajectory for the virtual projectile that passes into the grid array;

d) the processor moving the virtual projectile on the visual screen along the selected trajectory;

e) each virtual projectile having a designated frame penetrating strength;

f) each moved virtual projectile passing into frames until the virtual projectile exhausts its frame penetrating strength and eliminating symbols in each frame the virtual projectile penetrates;

g) the processor accumulating all symbols eliminated in ordered arrays of like symbols or orders of symbols; and h) after all projectiles have been moved and all eliminated symbols accumulated, the processor resolves the received wager against a paytable stored in the memory, with amounts of award depending upon correspondence of the accumulated symbols to the paytable.

2. The method of claim 1 wherein the selected virtual projectile trajectory is displayed on the visual display as the virtual projectile trajectory is selected through player input controls.

3. The method of claim 1 wherein a virtual projectile launching device is shown on the display screen.

4. The method of claim 3 wherein the virtual projectile launching device is selected from the group consisting of guns, rifles, musket, bows and arrows, slingshots, laser emitters, and cannons.

5. The method of claim 1 wherein a number of the virtual projectiles is randomly provided after the wager is received.

6. The method of claim 1 wherein at least two different virtual sizes of projectiles are displayed, with different sizes of the projectiles indicating different frame penetrating strengths for different projectiles.

7. The method of claim 2 wherein at least two different virtual sizes of projectiles are displayed, with different sizes of the projectiles indicating different frame penetrating strengths for different projectiles.

8. The method of claim 3 wherein at least two different virtual sizes of projectiles are displayed, with different sizes of the projectiles indicating different frame penetrating strengths for different projectiles.

9. The method of claim 1 wherein at least two different virtual colors of projectiles are displayed, with different colors of the projectiles indicating different frame penetrating strengths for different projectiles.

10. The method of claim 2 wherein at least two different virtual colors of projectiles are displayed, with different colors of the projectiles indicating different frame penetrating strengths for different projectiles.

11. The method of claim 3 wherein at least two different virtual colors of projectiles are displayed, with different colors of the projectiles indicating different frame penetrating strengths for different projectiles.

12. The method of claim 1 wherein before projectiles have been moved, a proposed trajectory for a projectile is directed by player input controls, and the processor provides an image of the proposed trajectory over the grid array.

13. The method of claim 9 wherein before projectiles have been moved, a proposed trajectory for a projectile is directed by player input controls, and the processor provides an image of the proposed trajectory over the grid array.

14. The method of claim 10 wherein before projectiles have been moved, a proposed trajectory for a projectile is directed by player input controls, and the processor provides an image of the proposed trajectory over the grid array.

15. The method of claim 12 wherein the processor displays an accumulation table of what symbols will be collected by at least one trajectory with a single projectile.

16. The method of claim 13 wherein the processor displays an accumulation table of what symbols will be collected by at least one trajectory with a single projectile.

17. The method of claim 14 wherein the processor displays an accumulation table of what symbols will be collected by at least one trajectory with a single projectile.

18. The method of claim 15 wherein an accumulation of what symbols will be collected by multiple trajectories with multiple symbols is displayed by the processor on the visual display.

19. The method of claim 16 wherein an accumulation of what symbols will be collected by multiple trajectories with multiple symbols is displayed by the processor on the visual display.

20. The method of claim 17 wherein an accumulation of what symbols will be collected by multiple trajectories with multiple symbols is displayed by the processor on the visual display.

* * * * *